United States Patent [19]

Evers et al.

[11] 3,980,108

[45] Sept. 14, 1976

[54] ROUND MESH WEAVING MACHINE AND MULTI-OUTPUT POWER TRANSMISSION UNIT THEREFOR

[75] Inventors: Jack Rolf Evers, Torrance; Herbert Edward Rohrbacher, Whittier, both of Calif.

[73] Assignee: Bergandi Manufacturing Company, Inc., South El Monte, Calif.

[22] Filed: May 2, 1975

[21] Appl. No.: 573,999

[52] U.S. Cl. ..... 140/92.8; 72/53

[51] Int. Cl.[2] ..... B21F 27/04

[58] Field of Search ..... 140/92.3, 92.7, 92.8; 74/53

[56] References Cited

UNITED STATES PATENTS 1,005,480 10/1911 Schmid ..... 140/92.7

3,601,163 8/1971 Ellis ..... 140/92.8

*Primary Examiner*—Lowell A. Larson

*Attorney, Agent, or Firm*—Ellsworth R. Roston

[57] ABSTRACT

A round mesh weaving machine which may be used for producing fire screen, fencing, and the like which employs a transmission unit having a single power input and a plurality of power outputs. In the illustrated embodiment, the transmission unit produces a vertically reciprocating output for severing the wire needle; an oscillating output for precisely axially locating the coiled needles in a receiving trough; and a horizontally reciprocating output for positioning of the trough.

25 Claims, 11 Drawing Figures

11
13
15
17
17
19
21
23
25
27
55
75
75
75
76
77
83
87
89
91
91
91
121
123
IV
IV
CAM + GEAR BOX 131
133
134
135
137
139
141
142

131
133
134
135
137
139
141
142

VIII
VIII
76
51
39
41
37
43
45
51
91
31
73
77
27
87
75
91
45
59
61
123
55
57
21
89
33
31
21a
35
37
21b
27
42
45
39
47
41
49
51
43

83
85
89
123
113
21
55
125
57
61
115
67
69
63
65
111
87
135
133
105
127
107
137
109
131
145

ROUND MESH WEAVING MACHINE AND MULTI-OUTPUT POWER TRANSMISSION UNIT THEREFOR

BACKGROUND OF THE INVENTION

The present invention relates to a round mesh weaving machine for the construction of fireplace spark arrester screening, fencing, etc. More specifically, the invention relates to a drive unit which may be utilized to drive such a machine, or which may have other applications as will become apparent to those skilled in the art.

In the prior art, there are many applications for round mesh woven products. One of the most commonplace is the spark arrester screening used to prevent sparks from being projected from a fireplace into an area in which they can cause injury or damage. Similarly, such woven wire products have been used as fencing, etc.

In the past, such products have been manufactured by machines which have required a plurality of power inputs to accomplish various tasks such as severing the coiled needle, positioning the needles, etc. Further, most of the prior art machines utilized bulky, expensive, and complex systems of gears, levers, etc., to accomplish all of the required tasks, making the machines prohibitively expensive and difficult to adjust and maintain.

There has therefore been generated a requirement to provide a round mesh weaving machine which will accomplish the production of such a product in a reliable manner and at a speed at least comparable to that of the prior art machines, while reducing the complexity and cost.

SUMMARY OF THE INVENTION

The present invention relates to a machine, and particularly to the power unit for driving such a machine, which accomplishes the production of a round mesh woven product. A machine which may be constructed in accordance with this invention, for example that which will be illustrated and discussed in the accompanying drawings and detailed description, may be produced at a relatively low cost. It can use mechanically interrelated structures which provide all of the necessary power outputs for accomplishing the required tasks, while requiring only a single input. A relatively simple transmission unit for conversion of that input into a plurality of outputs may be used. The entire transmission may be contained within an oil bath in a relatively compact housing, eliminating potential danger to the machine operator.

In the preferred embodiment, an endless wire may be fed by a pair of pinch rollers to a coiling die to form a needle having a spring-like shape with a predetermined and constant diameter. The coil may be rotated about its longitudinal axis as it leaves the die and will advance in the manner of a turning screw. Using this analogy, the distance between adjacent portions of the coil will hereinafter be referred to as the pitch of the coil, just as is the distance between adjacent threads on a screw. In this case, the pitch will be maintained at a constant dimension which may be altered by adjusting or replacing the coiling die.

The rotating needle may be fed into a receiving trough for a predetermined distance, at which time the pinch rollers may be stopped. Simultaneously, one output from the transmission unit may be utilized to drive a severing device against the needle, causing the portion thereof within the receiving trough to be severed from what then becomes the leading end of the needle.

As the needle is pushed into the receiving trough, it is rotated about its axis, causing it to be interwoven within the coils of the coiled section which was last severed from the needle. After the severing of the needle is accomplished as described above, another output of the transmission may be utilized to pull the immediately next-to-the-last formed coiled section from the trough. This causes a repositioning of the newly received coiled section in the trough, fixing the location of the axis of that coiled section so that the incoming needle may be properly interwoven in its coils.

At substantially the same time, another output of the transmission unit may be utilized to reposition the trough approximately one-half the pitch dimension of the coils in the coiled section so that the resultant product will have a uniform height across its width (as considered when the coil axes are vertically oriented).

With a machine formed in accordance with the present invention, a variety of advantages are made available for the production of a woven mesh product. Many of those advantages will be readily apparent from the following Detailed Description. However, a study of that Detailed Description will also reveal to those skilled in the art that the present invention also produces the advantages of providing a single housing for maintaining an entire transmission structure which, if desired, may operate within an oil bath; the structures within the transmission have relatively low inertias which allows a much faster operation of the machine using high strength materials; the axial and lateral motions of the coiled sections may be accurately and precisely controlled through various adjustability features provided; and the needle may be manually severed at the operator's desire to facilitate feeding of the machine, etc.

With the prior art machinery, the accomplishment of all of these functions required relatively complex, and even "Rube Goldberg-type mechanisms," and/or multiple power inputs. Therefore, it is believed that one of the primary features of the present invention comprises the use of a relatively simple and inexpensive transmission unit employing only a single power input, while providing three distinct power outputs. A review of this paper by those skilled in the art will quickly make it apparent that such a transmission unit could also have useful application in a variety of other machines and/or in accomplishing additional functions. However, for present purposes, the discussion will be limited to use of the transmission in its described environment, i.e., a round mesh weaving machine formed in accordance with the present invention.

DETAILED DESCRIPTION

Figure 1:
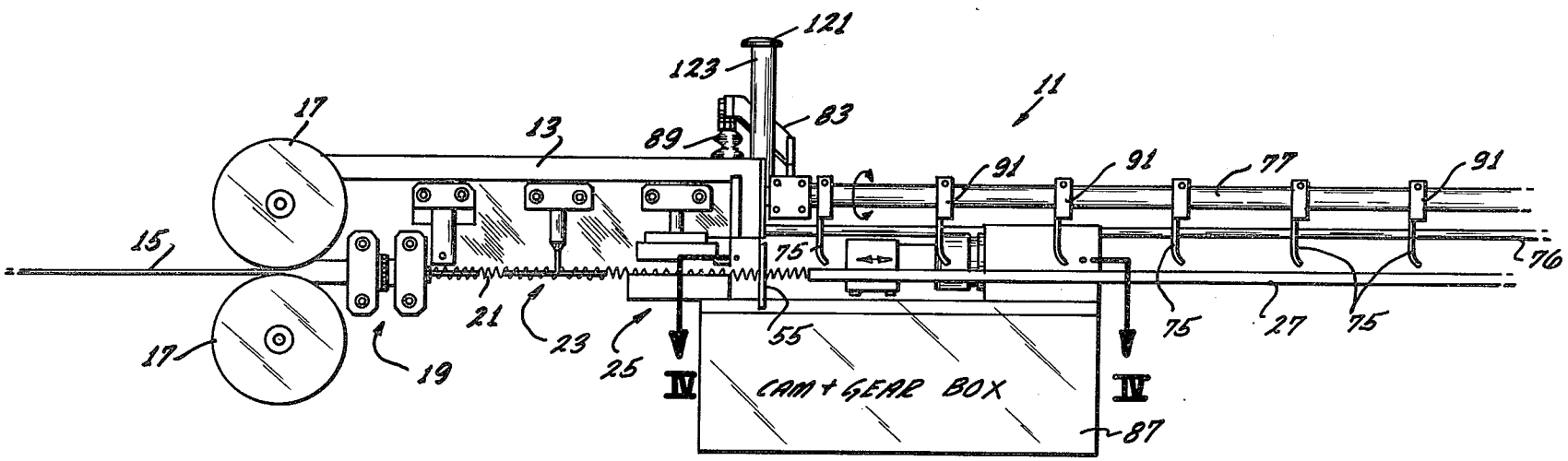
FIG. 1 comprises a partial front elevation of a machine formed in accordance with the present invention and utilizing the novel transmission unit, labeled "Cam and Gear Box"

Referring now to the drawings in greater detail, there is shown in FIG. 1 a portion of a round mesh weaving machine generally illustrated at 11 and including a supporting frame partially shown at 13. At the left end of this illustration of the preferred embodiment, there is shown an endless wire 15 which may be drawn from a spool or other device (not shown) by a pair of opposed pinch or nipping rollers 17 which feed the wire into a coiling die, generally illustrated at 19, to form a coiled needle 21 which, after passing over various supporting elements 23, 25, etc., is pushed into a receiving trough 27.

Figures 2, 8:
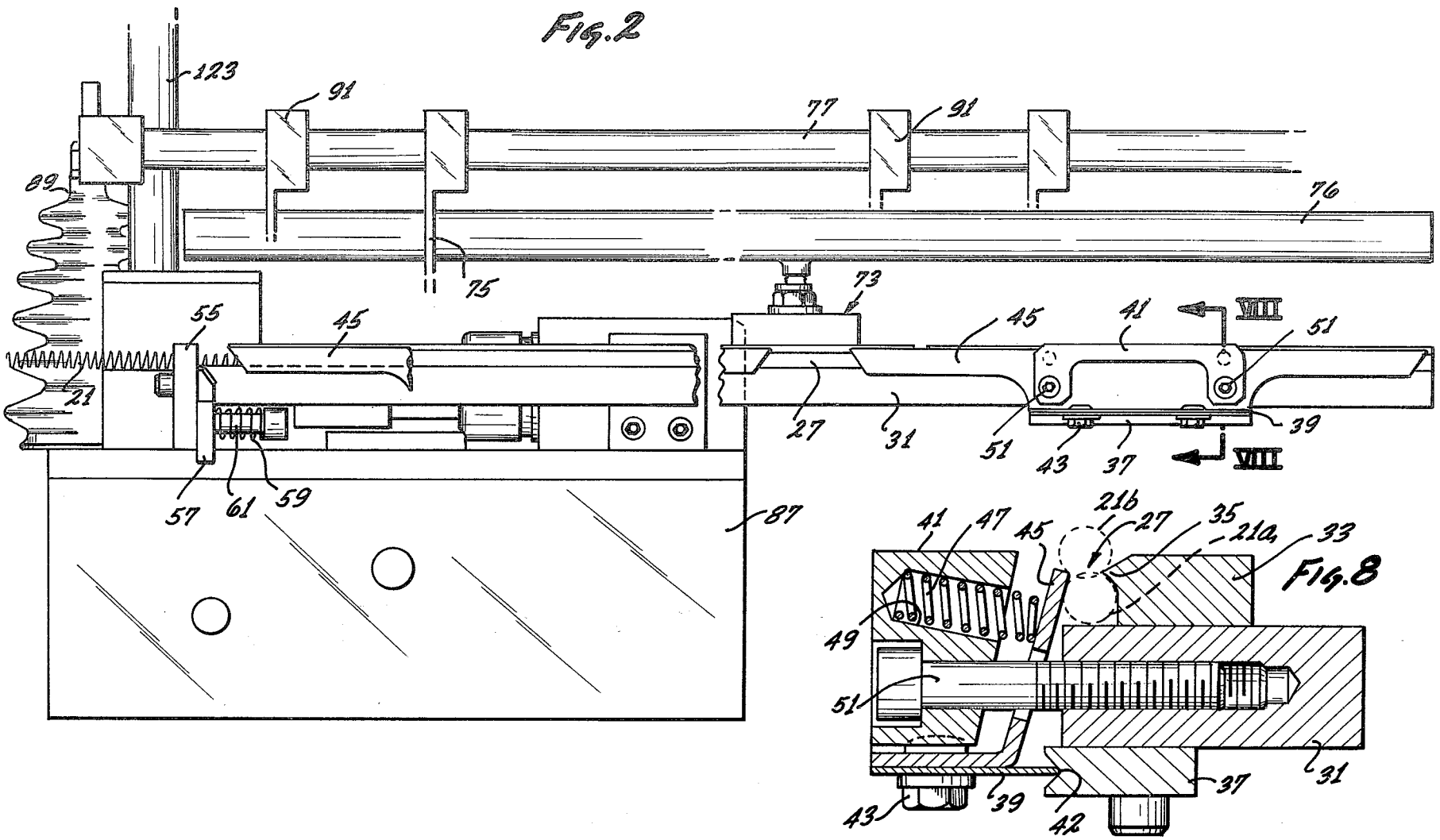
FIG. 2 comprises an enlarged portion of the machine illustrated in FIG. 1, with certain sections thereof broken away to more clearly illustrate the details thereof.
FIG. 8 comprises a side sectional view of the receiving trough and its spring-biased presser plate employed in the preferred embodiment of the present invention, as seen along the line VIII—VIII of FIG. 2.

Referring to FIGS. 2 and 8, it can be seen that the trough 27 is generally formed by a base member 31 to which is suitably attached a fixed gripping element 33 having an extension or nose 35 thereon which is located over the open area of the trough to assist in retaining the coiled needle in the trough. At suitable locations, pivot blocks 37 may be mounted on the lower portion of the base 31 for cooperation with a complementary pivoting element 39 in the manner shown in FIG. 8.

The pivoting element 39 may be fixed in any suitable manner to a presser plate 45, such as by means of bolts 43 as shown in FIGS. 2 and 8. Located near the center of each presser plate 45, a reactor block 41 may be fixed to the base member 31 by suitable means such as bolts 51. In other words, the reactor blocks 41 and the presser plates 45 are independently connected to the base member 31.

The presser plate 45 may be biased toward the receiving trough 27 by means of a spring 47 which may exert a force against the bottom of the bore 49 in the reactor 41. When a coiled section is pulled from the trough in a manner to be described hereinafter, the presser plate 45 and pivoting element 39 are pivoted against the force exerted by spring 47 about the line of abutment of the element 39 with the pivot block 37. In this manner the presser plate 45 will exert equal pressing force on the coil within the trough throughout the entire length of the plate 45.

A plurality of such reactor plates 41 may be used to close the front or open edge of the trough by biasing presser plates thereagainst in the manner illustrated in FIG. 8. These structures can be mounted at various positions along the trough and in such numbers as may be required by the length of the woven mesh product which is to be manufactured.

Figure 5:
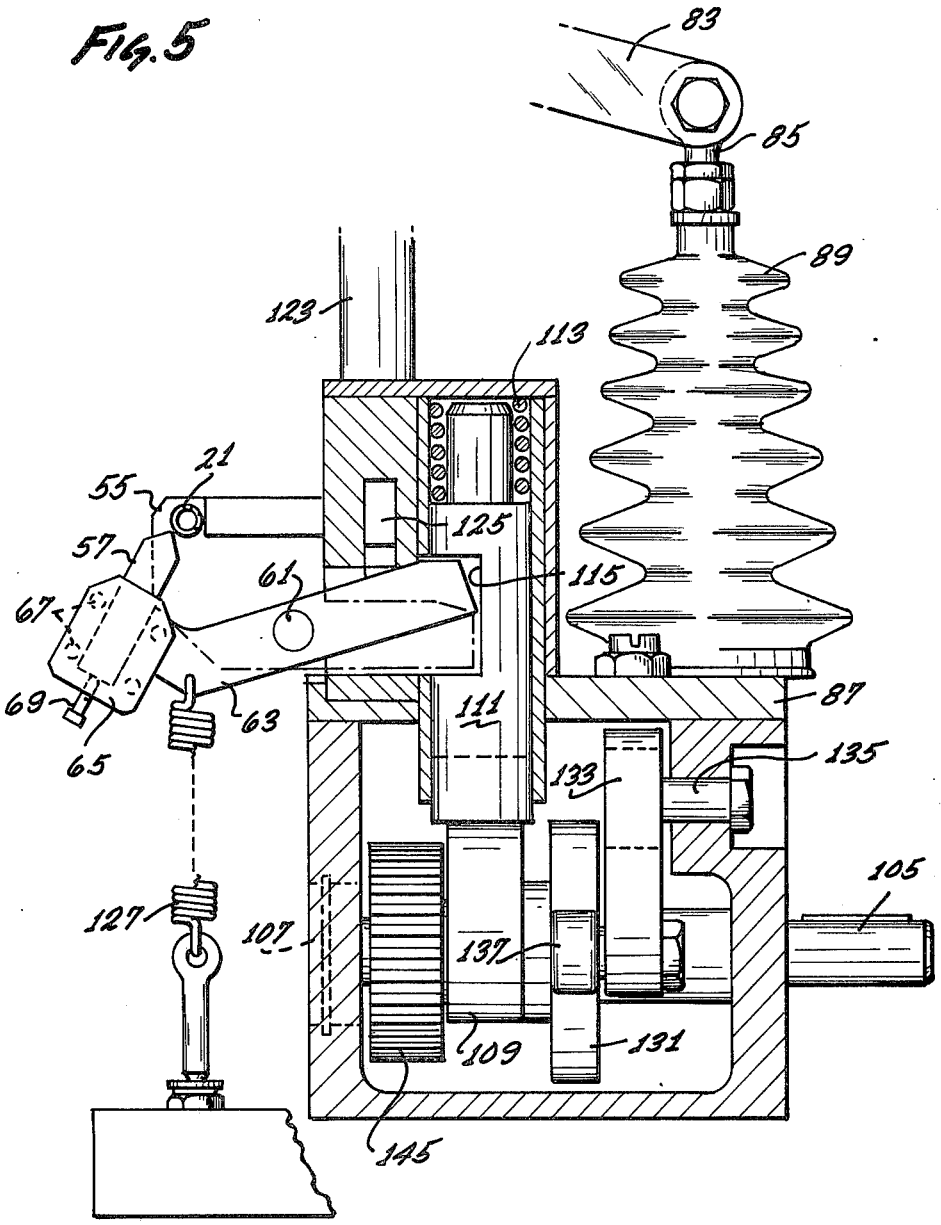
FIG. 5 comprises a sectional view of the novel transmission as seen along the line V—V of FIG. 3.

Referring again to FIGS. 1 and 2, it can be seen that as the coiled needle is pushed toward the trough 27, it may be passed through a sharp-edged aperture in a fixed blade 55 for severing thereagainst by a movable blade 57 (FIG. 5) mounted in a carrier 63. The latter may be biased toward the blade 55 by a spring 59 acting along a rod or bolt 61. Bolt 61 may be fastened to or fixedly seated relative to the fixed blade 55 and may extend through the movable blade arm 63 as shown in FIGS. 2 and 5. Thus, the movable blade arm may pivot about the rod 61 and be biased thereagainst by the spring 59. The movable blade 57 is in close surface abutment with the fixed blade 55 to sever the coiled needle 21 when blade 57 is moved across the aperture through which the needle is pushed on its way into the trough 27.

As with the other structure of this preferred embodiment, the movable blade structure may assume a variety of different configurations. In that configuration illustrated in FIG. 5, for example, the blade arm 63 may be attached to or integral with one surface of a minor housing section 65. A complementary section of the housing (not shown) may be suitably fastened to the housing section 65 by means such as bolts 67 so that the blade 57 can be held tightly between the opposed sections. If it is desired to adjust the position of the blade 57 as it becomes worn through use and it is reground to provide a new, sharp surface, the bolts 67 can be backed off slightly and an abutment screw 69 can be turned so as to extend further into the housing and reposition the trailing surface of the blade.

In the operation of the machine described thus far, the pinch rollers 17 pull the endless wire 15 from a spool, force it across a coiling die 19, through a fixed blade 55, and into the receiving trough 27 in the form of a coiled needle. The coiled needle is located in the receiving trough and rests against the bottom of the trough. As the needle is coiled and pushed toward the right in FIGS. 1 and 2, it is rotated about its axis. Consequently, as it is pushed into the trough 27, it becomes woven into the coils of the last preceeding coiled section.

When a predetermined length of coiled needle is located within the trough 27, the pinch rolls 17 are stopped. Substantially simultaneously, the blade arm 63 is pivoted about the rod 61 in a manner to be described hereinafter, causing the movable blade 57 to move across the aperture in the fixed blade 55 through which the coiled needle 21 has been pushed. This action causes severing of that portion of the needle which has passed through the fixed blade, forming what shall herein be termed a "coiled section."

Figure 6:
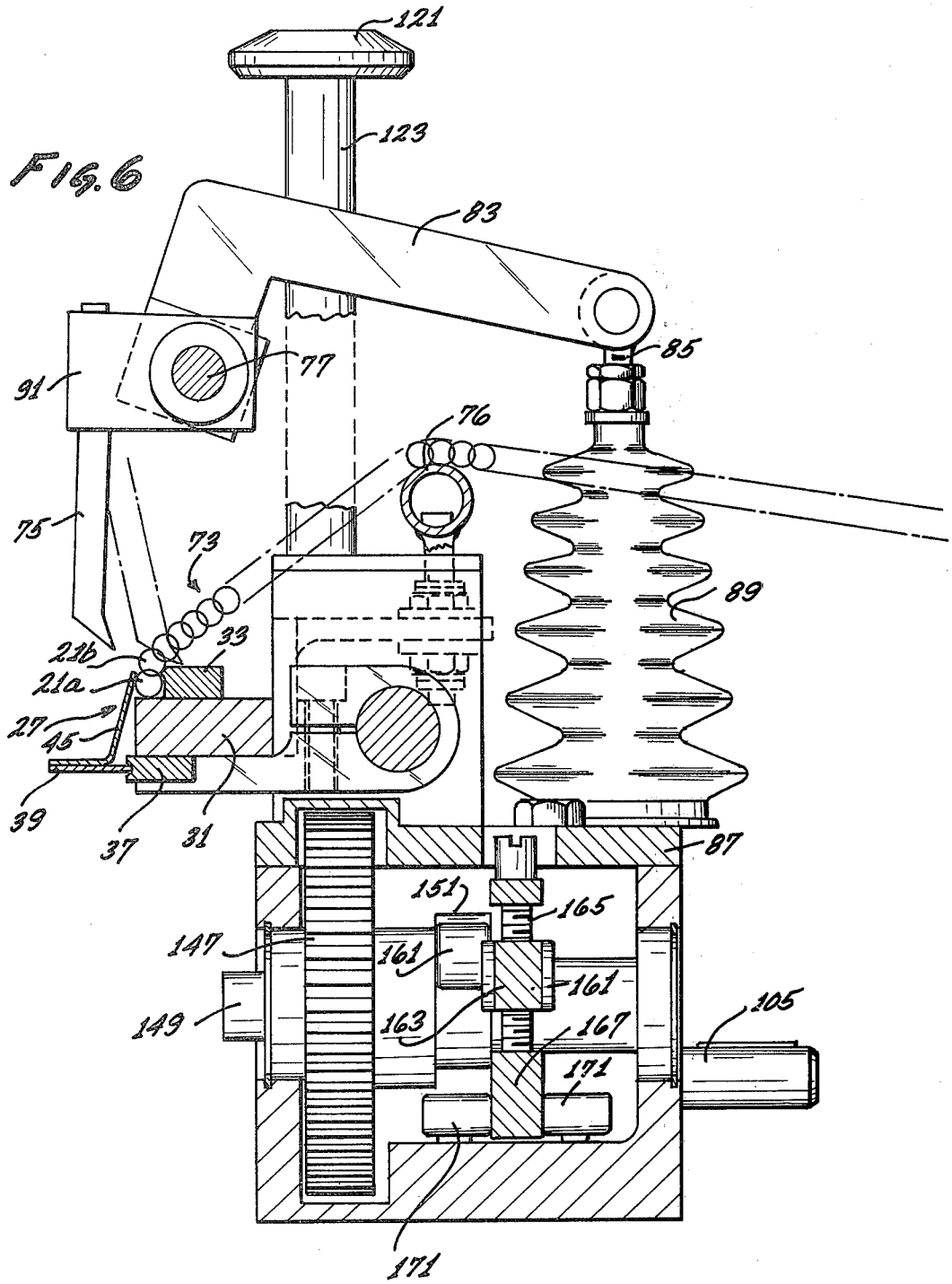
FIG. 6 comprises a sectional view of the transmission as seen along the line VI—VI of FIG. 3.

As shown in FIGS. 2 and 6, the trough base 31 is suitably connected through supporting elements 73 to a movable support bar 76. The round mesh woven product, comprising successive interwoven coiled sections is drawn across the bar 76 to suitable stations such as coiled section end knucklers, cutters, take up spools, etc.

After the coiled section, shown as 21*a* in FIG. 6, is located in the trough and severed from the coiled needle, a plurality of rocker arm fingers 75 as oscillated about a pivot rod 77, gripping and pulling on the woven mesh in the manner illustrated in phantom lines. This causes the next-to-the-last coiled section, shown as 21*b*, to be pulled perpendicular to its axis, from between the nose 35 and presser plate 45. This pulls the most recently formed coiled section 21*a* into position between the nose 35 and presser plate 45 so that the succeeding needle will be woven into it and the process repeated. When the fingers 75 have completed this task, they are moved back to the ready position out of contact with the mesh product.

Figure 4:
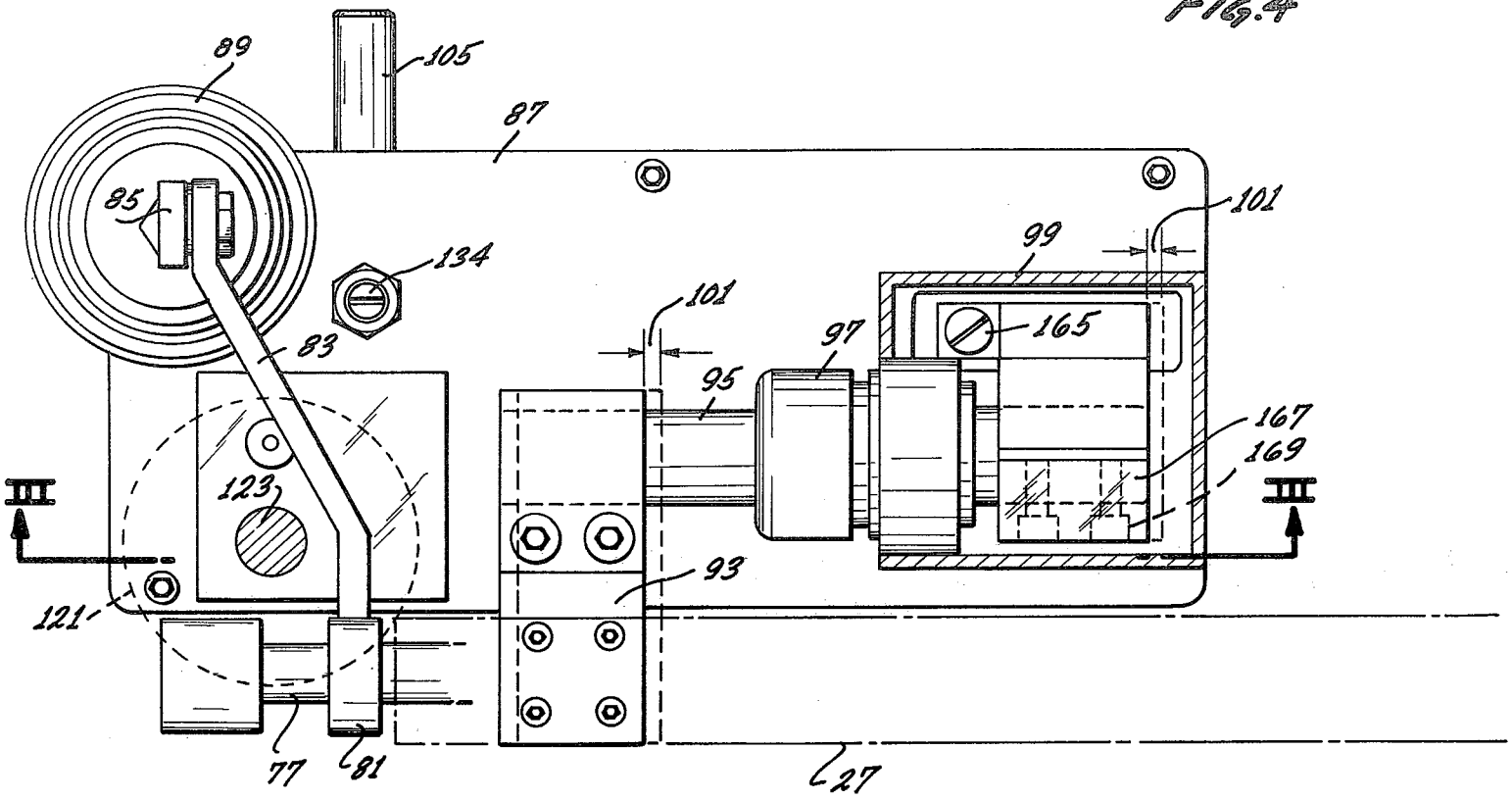
FIG. 4 comprises a top plan view, partly in section, of the transmission formed in accordance with the present invention, as seen along a line IV—IV of FIG. 1.

As shown in FIGS. 4 and 6, the rod 77 may be supported and fixed at one end thereof within a collar 81 which, in turn, may be fixed to or integral with a lever arm 83. In turn, the lever arm may be suitably attached to the upper end of a push rod 85 which is actuated by a mechanism within the transmission 87 in a manner to be described. As the push rod 85 is moved up and down as viewed in FIG. 6, it will oscillate somewhat about the center of the rod 77. For the sake of convenience, this combined oscillating and reciprocating motion may be referred to as "partial universal movement." For this reason, it may be desired to provide a dust seal 89 to encompass the push rod and seal off the opening in the top of the transmission 87 through which the push rod moveably passes. Thus, as the push rod is moved up and down, it will cause the lever 83 which is fixed to the rod 77 to rotate the rod about its axis. If desired, the dust seal may contain a spring or other means (not shown) to bias the push rod 85 upwardly, for a purpose to be described below.

Fingers 75 may be fixed to the rod 77 in any suitable manner and at suitable locations, for example by means of adjustable housings 91 which may be located as needed at predetermined positions along the rod and releasably fixed thereto. Thus, as the rod 77 is rotated by the substantially vertical reciprocation of the push rod 85, the fingers 75 will move between the two positions illustrated in FIG. 6.

In order to prevent one, or more, of the coiled sections in the finished product from rotating about its axis and thus breaking the weave, it is often necessary to knuckle or bend the end of each coiled section over the wire at the extreme end of the adjacent coiled sections. In order to accomplish this, however, it is necessary to form the product in such a way that the ends of adjacent sections are alternately offset from one another. For this purpose, it may be desirable to reciprocate the trough in an amount equal to one-half the pitch dimension. In order to accomplish this, as shown in FIG. 4, one end of the trough 27 may be suitably fastened to a trough bracket 93. In turn, the trough bracket 93 may be suitably fastened to a guide pin 95 which may be reciprocated, through a guide pin bushing 97 mounted on a clamping block 99, by a means to be described below.

As illustrated in FIG. 4, the dimension 101 depicts one half of the pitch dimension of the coiled sections, illustrating the distance which the trough may be moved. Thus, when a coiled section is positioned in the trough as previously described, the trough may be moved, for example to the right, a distance equal to the dimension 101. When the next coiled section is similarly positioned, the trough may be moved the distance 101 to the left. As a result, adjacent coiled sections are alternately offset a sufficient amount so that the ends can be knuckled or bent over the extreme coils of the adjacent coiled sections, thus locking them together.

If desired, after the trough has been shifted in one direction or the other, the rod 77 can again be rotated about its axis by movement of the push rod 85. This will cause the fingers 75 to push against the woven product in a controlled amount, causing the product to be retensioned against the force of the presser plate 45 and/or the last-formed coiled section to be accurately located in the trough in its axial direction. This latter would be in the manner of "fine tuning," so to speak.

Thus it can be seen that the transmission 87 provides outputs to move the cutter blade arm 63 about its pivot 61, to move the fingers 75 about the pivot rod 77, and to reciprocate the trough. In the past, it was necessary to accomplish these tasks at a relatively low speed because of the necessity of accomplishing them in a precise sequence using high mass mechanisms. A complex mechanical system had to be employed and/or a different drive system for each task and a means to coordinate the drive systems had to be provided.

In the present invention, on the other hand, a single power input shaft 105, which may be driven by any suitable motor, etc., (not shown) may be utilized to power the transmission 87 to accomplish all of these tasks. As shown particularly in FIGS. 3 and 5, the shaft 105 may be suitably mounted in bushings such as that partially illustrated at 107, for rotational support within the transmission. In order to accomplish the above-described pivoting of the movable blade arm 63, the face of a cutter cam 109 may be followed by a striker 111, actuated by any suitable means such as a spring 113. The striker may be provided with a recess 115 into which the end of the blade arm 63 may extend in the manner shown in FIG. 5.

Figure 3:
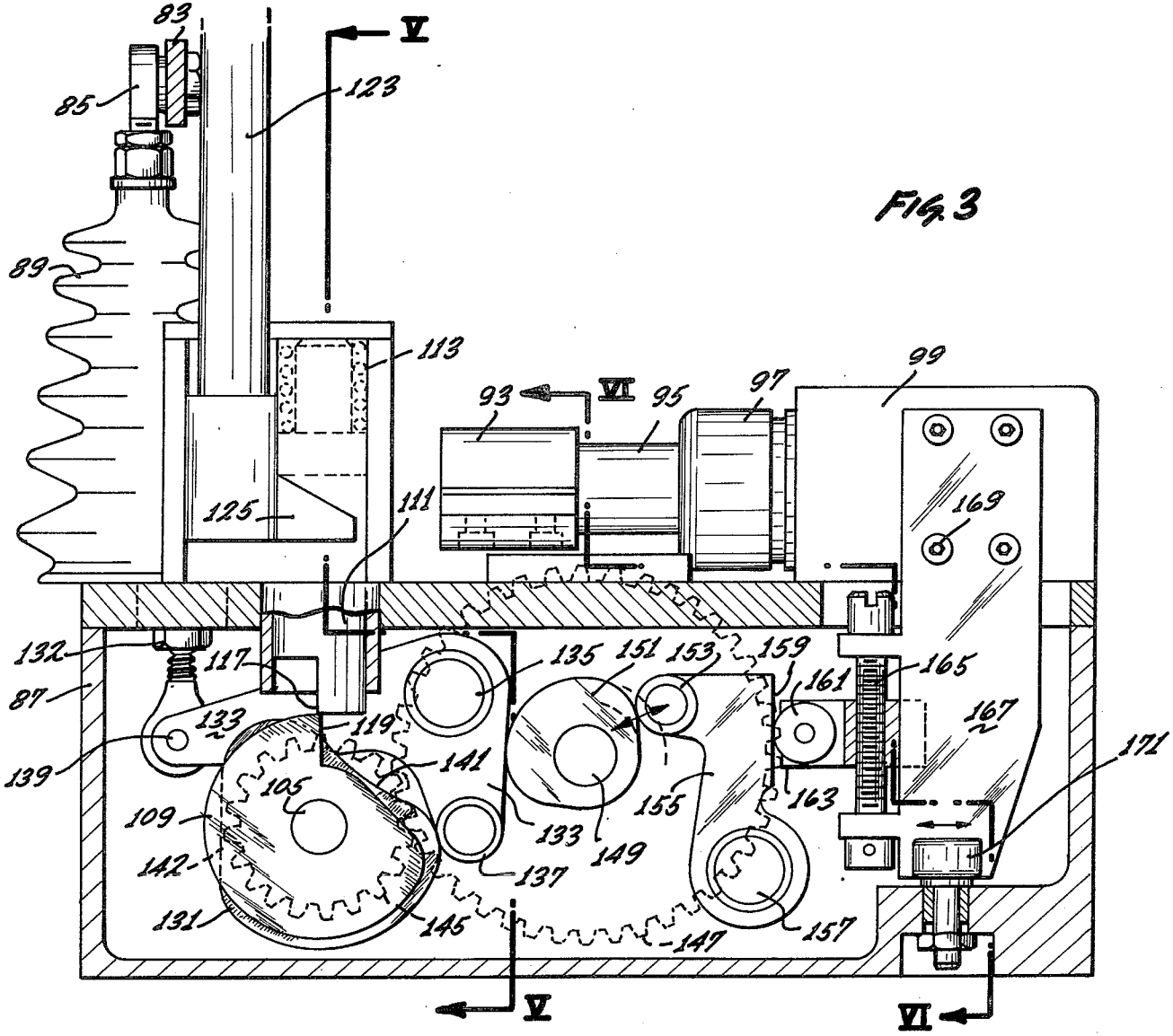
FIG. 3 comprises a front view of the novel transmission, partly in section to illustrate certain details, as seen along a line III—III of FIG. 4.

As shown in FIG. 3, the lower end of the striker may be provided with an abruptly cut off section 117 which may cooperate with a shoulder 119 on the cam 109. Thus, as the shaft 105 rotates, it will cause the cam 109 which is fixed thereto to rotate until the shoulder 119 moves counterclockwise (as viewed in FIG. 3) just past the point illustrated in FIG. 3. When this occurs, the spring 113 will drive the striker 111 downwardly, as seen in the drawing, forcing the blade arm 63 to move about the pivot 61 until it is located in the position illustrated in phantom in FIG. 5. As can be seen, this will cause the blade 57 to pivot past the sharp-edged aperture in the fixed blade 55, causing the blade 57 to sever the needle 21 and thus form a coiled section.

At times, such as when the machine is first threaded and set up for use, it may be desirable to manually actuate the movable blade to sever the needle. In such an instance, the operator may merely strike a handle 121 (FIG. 1) to drive a manual striker 123 downwardly as seen in the drawing, against the force of a spring (not shown). When this occurs, a radial extension 125 suitably mounted on the manual striker will serve to actuate the blade arm 63 in a manner similar to that described for the automatic mode.

When the striker 111 is withdrawn against the force of the spring 113 by continued rotation of the cam 109, or when the manual striker 123 is withdrawn under the force of its spring, the movable blade arm 63 may be pivoted back to the full-line position shown in FIG. 5 by any suitable means, such as a coiled spring 127. Thus, in this manner, the movable blade 57 is withdrawn from the cutting aperture and is effectively positioned to provide suitable momentum to ensure sufficient cutting force when the arm 63 is pivoted about the rod 61.

Figure 7B:
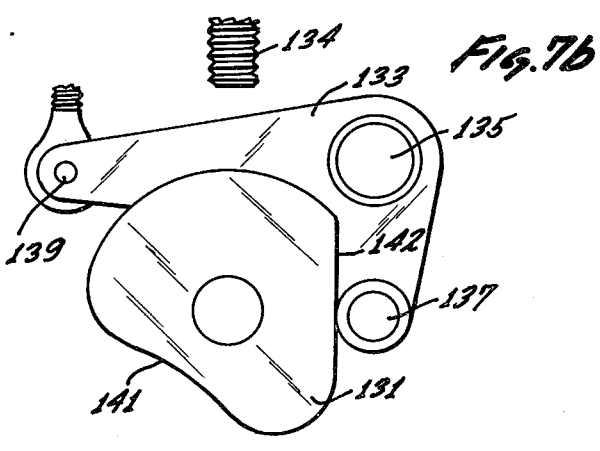
FIGS. 7*a* and 7*b* comprise side elevation views, in different positions, of the high speed cam and its follower (a third position thereof being illustrated in FIG. 3)
Figure 7A:
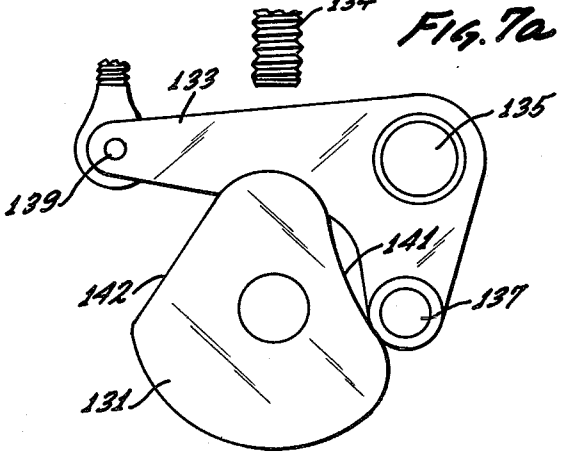

As shown in FIGS. 3, 5, and 7, there may also be mounted on the input shaft 105, a high speed cam 131 which is fixed for rotation therewith. A rocker arm 133 may be suitably mounted in the transmission housing 87 so as to pivot about a rod 135 which, if desired, may be utilized with a suitable bushing in the rocker arm. Near one end of the rocker arm, a cam follower 137 may be employed so as to cause the rocker arm 133 to pivot, in accordance with the configuration of the face of cam 131, about the pivot point 135.

At the opposite end of the rocker arm 133 from the cam follower 137, the lower end of the push rod 85 may be attached by suitable means such as a pin 139. Preferably, either the connection of push rod 85 at pin 139 and to the lever arm 83 will be sufficiently flexible, or a semiflexible link will be employed within the rod, to allow the push rod to be moved up and down under the influence of the rocker arm while its upper end pivots about the rod 77. In other words, the motion of the push rod will be partially universal, i.e., primarily and substantially vertical although its upper end will have the degree of arcuate movement sufficient to result in the oscillation of the fingers 75 about the axis of rod 77. It is for this reason that it is preferable to provide the dust cover 89 in order to allow the compound or partially universal motion of the push rod. It may also be deemed preferable to provide a means, for example within the dust cover 89, to bias the push rod upwardly to maintain the cam follower 137 in contact with the face of cam 131 at all times.

As seen in FIGS. 3 and 7, the cam 131 may be provided with recesses 141 and 142 in its face. When the cam follower 137 is in contact with the recess 141, the push rod will be moved to its most elevated position, causing the fingers 75 to be rotated to the phantom line position illustrated in FIG. 6. At other times, with the cam in the position illustrated in FIG. 3, the fingers will be maintained out of contact with the woven product. If desired, however, to "fine tune" the position of the coiled section 21*a* within the trough, as previously described, a second indentation 142 may be formed on the cam face. This identation 142, having a radius greater than that of the identation 141, will allow the fingers 75 to pivot in the manner illustrated in FIG. 6, but not so far as to pull the coiled section 21*a* out of the trough. With such a structure, the fingers will place a momentary tensioning force on the woven product which will accurately position the coiled section 21*a* for weaving, and positively prohibit the incoming needle from being woven into coil 21*b*.

In order to precisely adjust the positioning of the coils as they are initially pulled from the trough 27 and then repositioned in "fine tuning" a number of possible procedures would be available. However, the positioning for the fine tuning may be accurately adjusted by adjusting the length of the push rod 85. This might be accomplished, for example, by providing the push rod 85 to include a turnbuckle-like extension, partially illustrated, by way of example, at 132 in FIG. 3. Thus, when the cam follower 137 is positioned against the cam recess 142, the length of the push rod 85 may be carefully adjusted so that the fingers 77 exert a sufficient force on the coiled mesh product to reposition the coiled section then within the trough very accurately.

In order to control the position of the fingers 75 as the coiled section is pulled from the trough, a set screw member 134 (FIGS. 4 and 7) may be adjustably mounted in the cover of housing 87 so as to abut the upper edge of the cam follower 133. In other words, by adjusting the distance which the set screw 134 extends into the housing, the degree of pivot of the cam follower 133 may be accurately controlled so that only a portion of the available travel distance of the fingers 75 is utilized. This would be advantageous, for example, if the same machine were to produce a variety of woven mesh products with distinctive coil diameters, pitches, etc.

As stated previously, it may be desirable to reciprocate the trough by a distance equal to the dimension 101 illustrated in FIG. 4. For this purpose, a drive gear 145 may be suitably fixed on the power input shaft 105 as illustrated in FIGS. 3 and 5. Preferably, the drive gear is positioned so as to be in constant mesh with a driven gear 145 mounted on a low speed shaft 149. A low speed cam 151 may also be mounted on the shaft 149 for rotation therewith. As the shaft 149 is rotated by the driven gear 147, the cam 151 may act against a cam follower 153 mounted on a rocker arm 155 which pivots about a fixed shaft 157.

The rocker arm 155 may be provided with a face 159 which cooperates with a roller 161 mounted in a cam yoke 163. In turn, the cam yoke may be threaded onto a stroke adjustment screw 165. The end of the cam yoke opposite the roller 161 may extend in a U-shaped manner, along either side of a guide bar 167; thus, the yoke is always oriented so that the roller 161 cooperates with the face 169 on the rocker arm 155.

The stroke adjustment screw may be suitably fixed to the guide bar 167, for example in the manner shown, so that as it is rotated in one direction or the other, the cam yoke 163 will be moved toward the top or the bottom of the transmission 87.

The guide bar 167 may be attached to the clamping block 99, for example by means of bolts 169. Thus, movement of the guide bar 167 toward the right or left as illustrated in FIG. 3 will cause the guide pin 95 to move in the same direction, thus moving the trough as previously described.

When it is desired to alter the pitch of the needle for any reason, e.g., by utilizing a different coiling die, it may be necessary to adjust the dimension 101 by which the trough is reciprocated to ensure the uniform height of the woven product. In order to do this, the stroke adjustment screw 165 can be rotated. If the dimension 101 is to be increased, the screw can be rotated to elevate the yoke 163, thereby precisely increasing its distance from the pivot 157 and increasing the horizontal dimension through which it will be moved by the rocker arm 155 under the influence of cam 151. On the other hand, if the dimension 101 is to be decreased, the adjustment screw 165 can be rotated in the opposite direction, lowering the cam yoke 163, i.e., moving it closer to the pivot point of the rocker arm, thereby precisely reducing the distance through which the guide bar 167, and thus the trough 27, will be reciprocated.

Any suitable means may be be provided to locate and support the guide bar 167 so that it may be reciprocated without danger of separating the roller 161 from the face 169. In the illustration of FIGS. 3 and 6, a pair of rollers 171 may be located on either side of the lower portion of the guide bar 167 to guide it in properly oriented reciprocation, whereas the guide bar's attachment to the guide pin 95 will suitably locate and orient the upper end thereof. Of course, in order to maintain the guide bar 167, cam yoke 163, and rocker arm 155 in such a relationship that rotation of the cam 51 will always be transmitted as motion of the trough, a suitable biasing means (not shown) may be provided, tending to force the trough, the guide pin 95, and the guide bar 167 toward the left, as seen in FIG. 3.

In its preferable method of operation, as illustrated in the attached drawings, the transmission or power input shaft 105 may be driven by an electrical impulse-actuated, single-revolution clutch which causes the input shaft 105 to complete one full revolution and then stop to await the next control impulse. When the pinch rolls 17 feed a rotating needle into the trough a predetermined distance, one or more electrical impulses may be used to stop the pinch rolls and actuate the single-revolution clutch. The shaft 105 will commence to rotate so that the cam 109 causes a severing of the needle as previously described and the cam 131 causes the fingers to pull the now-woven, coiled section 21*b* out of the trough.

If the gears 145 and 147 are, preferably, on a 2:1 ratio, the full rotation of the input shaft 105 will cause the low speed cam shaft 149 to rotate 180°. This will cause the trough to move in one direction a distance equal to the predetermined dimension 101 which has been set to equal approximately one-half the pitch of the needle. If desired, a suitable configuration of the cam 131 may then cause fingers to accurately locate the coiled section 21*a* in the trough 27 as previously described. Immediately thereafter, the clutch may be deactivated and the pinch rolls rotated once more to weave the incoming needle into coiled section 21*a*. In the next cycle, the rotation of the shaft 149 the second 180° will cause the trough to be moved the dimension 101 in the opposite direction.

It has previously been stated that it may be preferable to provide a means within the dust cover 89 to bias the push rod upwardly so as to maintain cam follower 137 in contact with the face of cam 131. Similarly, it has been stated that a suitable biasing means might be provided to force the trough 27, guide pin 95, and guide bar 167 into a position such that rotation of cam 151 will always result in a force transmittal to the trough.

Figure 9:
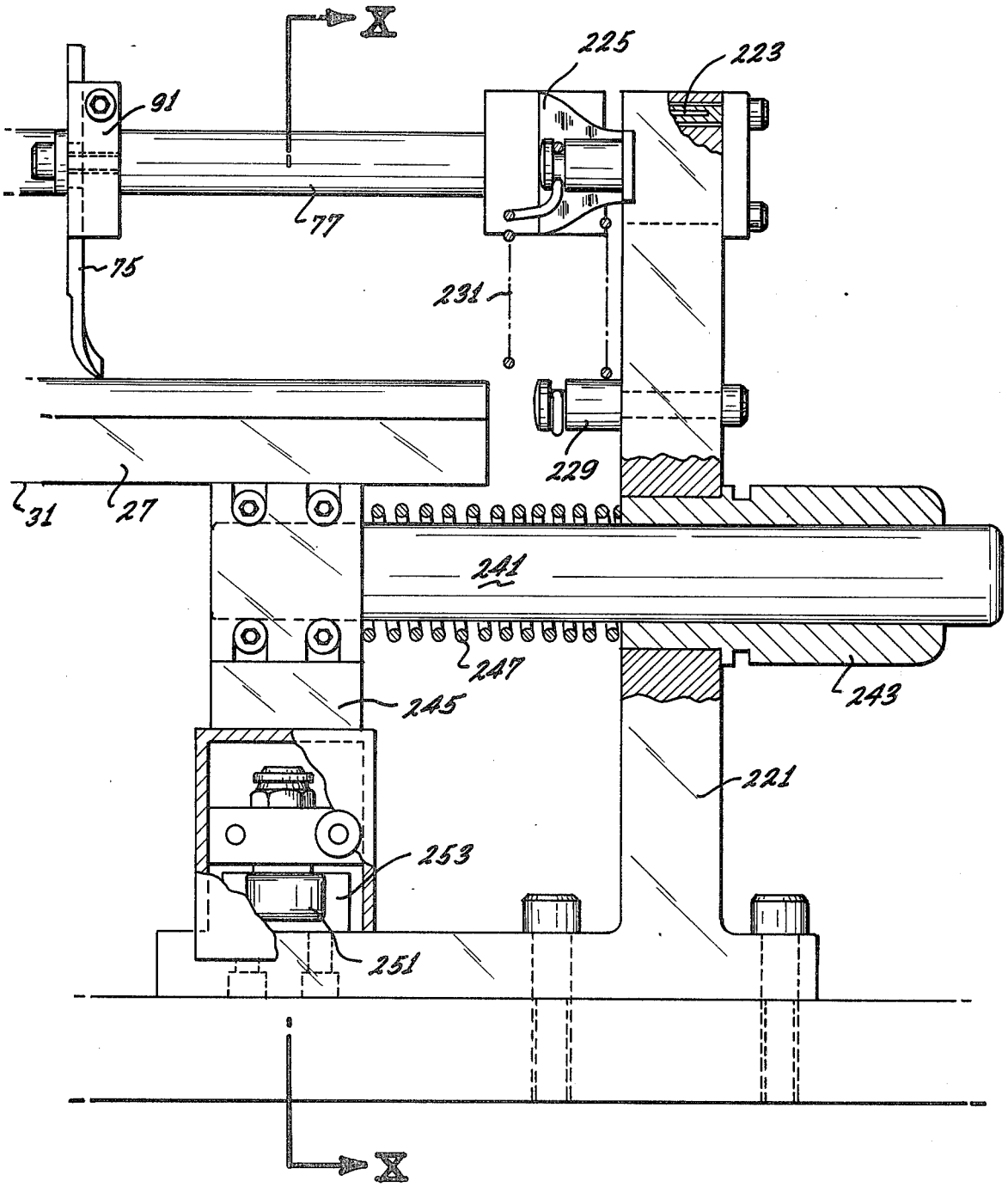
FIG. 9 comprises a front elevation, partly in section of a support structure which may be used with the present invention.
Figure 10:
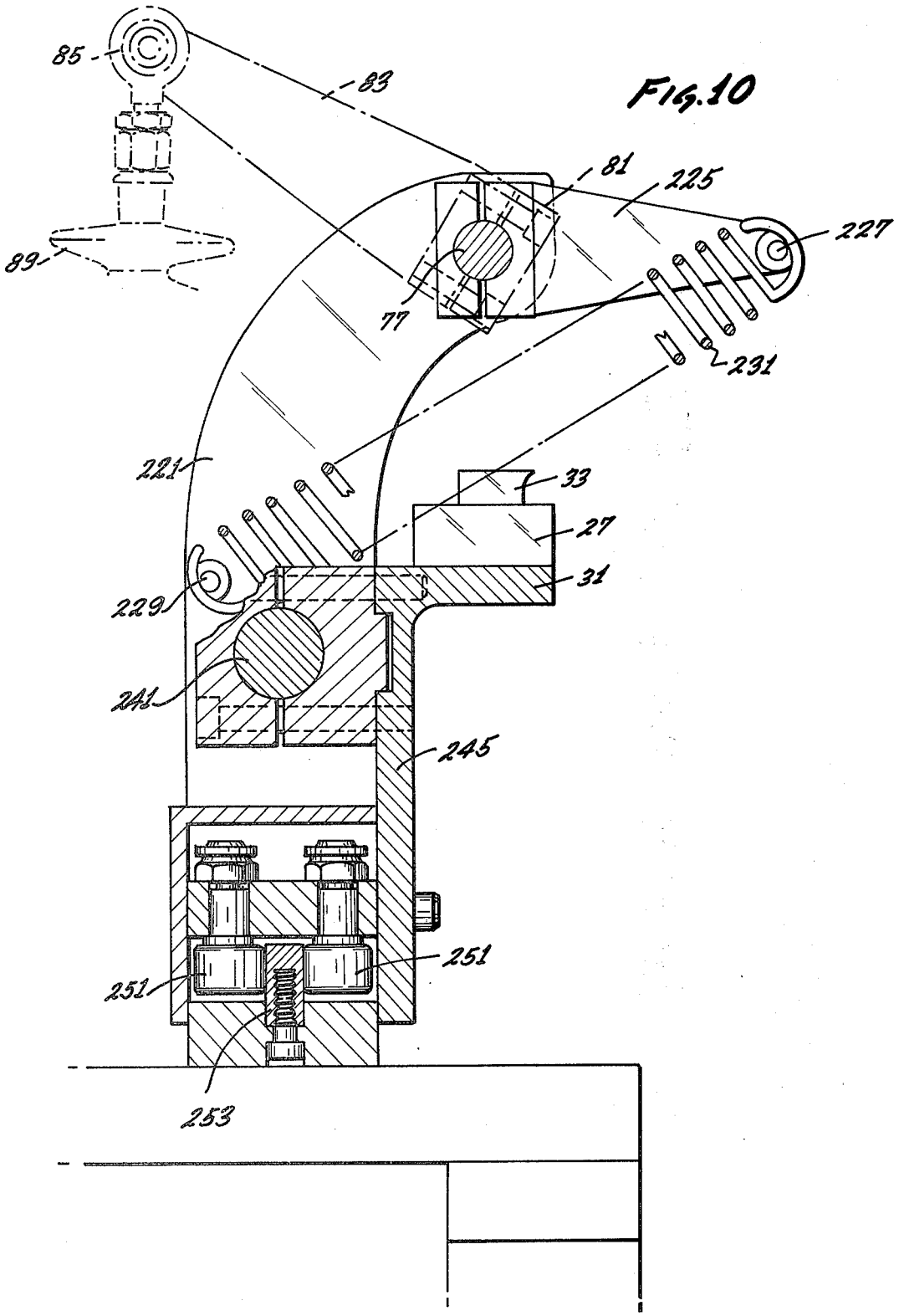
FIG. 10 comprises a sectional elevation of the structure shown in FIG. 9, as seen along the line X—X thereof.

In order to avoid having to use a spring within the dust cover 89, which might result in undue wear at the connection between push rod 85 and lever 83, structure to accomplish that degree of biasing necessary to maintain the cam followers in constant contact with their associated cams has been illustrated in FIGS. 9 and 10. As shown in those figures, an upright support member 221 may be provided for supporting the otherwise free end of the rod 77 and trough 27; this support would, if shown, be at the right-hand side of FIGS. 1 and 2.

The support 221 may be fitted with a bearing 223 for rotational support of the end of rod 77. Adjacent that end of the rod, a lever 225 may be provided. Between an attachment pin 227 fixed to the lever and a second attachment pin 229 fixed to the support 221, a coiled spring 231 may be provided which will tend to rotate the rod 77 clockwise, as seen in FIG. 10, thereby always forcing the lever 83 to rotate so as to pull the push rod 85 out of the cam and gear box or transmission 87. As will quickly become apparent from a brief review of FIG. 3, the biasing force exerted by the spring 231 will therefore cause the cam follower 137 to be maintained in constant contact with the cam 131. In other words, a continuous mechanical cooperation is thus constantly maintained. Since this biasing force is transmitted throughout the system which includes lever 83 and push rod 85, the force direction through their connection is constant and any play between them will not result in wear of the connection which could alter the movement of the fingers 75. On the other hand, if wear should occur, the adjustment of the lever 225 on the rod 77 is a very simple matter for one skilled in the art and the spring 231 will then continue to operate in the same manner without requiring a long "down time" for repair of the machine.

A rod 241 may be fixed in the support 221, for example by a bearing or similar element 243. As shown in FIGS. 9 and 10, a slidable support 245, to which the trough base 31 may be fastened, may be located on the end of the shafts 241. A spring 247 may be located about the rod 241 to exert a biasing force between the support bearing 243 and the slide 245. As a result, the slide 245 will be biased toward the left, as seen in FIG. 9, forcing the trough in the same direction. A brief review of FIG. 3 will quickly reveal that the biasing force of spring 47 will therefore cause the guide bar 167, the cam follower 153, and the structure intermediate those elements, to always comply with the motion generated by the rotation of cam 151.

In order to prevent the trough from twisting as the coiled sections are pulled therefrom, the lower portion of the slidable support 245 may be provided with a pair of rollers 251 which act against either side of a suitable support structure 253 in the manner illustrated in FIGS. 9 and 10. Thus, the free end of the trough is held against twisting about the axis thereof while, at the same time, all of the structure between the free end and the cam 151 is maintained under a biasing force which limits the wear which may be developed by friction between the structural elements. Since the roller 61 may be vertically adjusted by the adjustment screw 165, if any wear should develop in the system, it may be quickly eliminated by correction of the vertical position of the roller 161.

With this invention, which may be utilized in a variety of different embodiments including that here described and illustrated, a very simple mechanism may be employed to form a woven mesh product at speeds much greater and at costs much lower for production and maintenance, than heretofor possible. Those skilled in the art will immediately realize that a variety of structures may be employed to accomplish these results, without exceeding the scope of the present invention.

We claim:

1. A high speed, low inertia, power transmission unit comprising a housing, a rotary power input means for delvering power into said housing, first cam means in said housing operatively connected to said rotary power input, means in said housing actuated by said first cam means for generating a first substantially oscillating power output from said housing, second cam means in said housing operatively connected to said rotary power input, means in said housing actuated by said second cam means for generating a first substantially reciprocating power output from said housing, third cam means in said housing operatively connected to said rotary power input, and means in said housing actuated by said third cam means for generating a second reciprocating power output from said housing.

2. The transmission unit of claim 1 including
means in said housing for actuating said third cam means at approximately one-half the speed of said first and second cam means.

3. The transmission unit of claim 1 wherein
said means actuated by said second cam means includes
means for generating a partial universal output from said housing.

4. The power transmission unit of claim 1 including
means connected to said first substantially oscillating power output generating means for moving an elongated work piece perpendicular to its elongated dimension,
means connected to said first reciprocating power output generating means for severing an elongated work piece at a predetermined position along its elongated dimension, and
means connected to said second reciprocating power output generating means for moving an elongated work piece parallel to its elongated dimension.

5. The transmission of claim 1 including
means, exterior of said housing, for exerting a continuous biasing force upon at least one of said transmission output generating means.

6. The transmission of claim 5 wherein
said biasing means further acts upon said at least one output generating means to cause continuous mechanical cooperative relationship with its related cam means.

7. The transmission of claim 1 wherein
said housing is filled with oil for lubrication of all of the recited mechanical elements therein.

8. The transmission unit of claim 1 including means in said housing for accurately adjusting said first power output generating means to control the work delivered thereby.

9. The transmission unit of claim 1 including means in said housing and extending therefrom for manually actuating said first power output generating means.

10. A low inertia, high speed, power transmission unit comprising
a housing,
a rotary power input shaft extending from said housing to be driven by a power drive means,
a first cam in said housing on said input shaft,
a first power output means mounted in said housing and extending therefrom,
cam following means in said housing associated with said first cam for actuation of said first output means in a substantially reciprocating and partially universal motion,
a second cam in said housing on said input shaft,
a second power output means mounted in said housing and extending therefrom,
cam following means in said housing associated with said second cam for actuation of said second output means in a reciprocating motion,
a cam support shaft mounted in said housing
a third cam in said housing mounted on said support shaft,
a third power output means mounted in said housing and extending therefrom,
cam following means in said housing associated with said third cam for actuation of said third output means in a reciprocating motion, means in said housing operatively connecting said input shaft to said cam support shaft such the speed ratio of the two shafts is 2:1, and
means in said housing for adjusting the distance that said third power output means may be moved by rotation of said third cam.

11. The transmission unit of claim 10 including means in said housing for adjusting the amount of substantially reciprocating and partially universal motion delivered by said cam following means associated with said first cam.

12. A round mesh weaving machine comprising
means for feeding a continuous length of wire to a coiling die means,
coiling die means for converting the continuous length of wire into a coiled needle of uniform diameter and for rotating the coil about its longitudinal axis as it leaves said die means,
means for receiving the coiled wire as it leaves said coiling die means,
means for retaining a first coiled section of wire of predetermined length in a predetermined position in which its longitudinal axis is parallel to the longitudinal axis of the coiled needle leaving said coiling die means such that said longitudinal axes are offset by less than the diameter of said first coiled section of wire, and for receiving the incoming coiled needle such that the rotation of the coiled needle leaving said coiling die causes the coiled needle and the first coiled section of wire to be threaded together, said retaining means comprising
a base member,
fixed gripping means mounted upon said base member and extending into cooperative relationship with said receiving means,
presser plate means pivotally mounted on said base member in cooperative relationship with said fixed gripping means, and
means mounted on said base member for releasably biasing said presser plate means toward said fixed gripping means, and
power transmission means including
a housing containing
a power input means,
first cam means operatively connected to said power input means,
means actuated by said first cam means for severing said coiled needle when a predetermined length thereof is positioned in said receiving means, thereby forming the severed portion into a second coiled needle,
second cam means operatively connected to said power input means,
means actuated by said second cam means for moving the first coiled section of wire perpendicular to its axis and out of said retaining means and for moving the second coiled section of wire into the predetermined position vacated by said first coiled section,
third cam means operatively driven by said power input means, and
means actuated by said third cam means for moving the second coiled section parallel to its axis a distance equal to approximately one-half the pitch of the coil.

13. The machine of claim 12 including
power transmission means interposed between said power input means and said third cam means to cause the latter to rotate approximately 180° for each 360° rotation of said first and second cam means.

14. The machine of claim 12 wherein
said moving means comprises
means for reciprocating said retaining means a distance equal to approximately one-half the pitch dimension of the coiled sections.

15. The machine of claim 12 including
means in said housing and extending therefrom for manually actuating said severing means.

16. The machine of claim 12 including
means in said housing for adjusting the distance which said second cam actuated moving means moves said first coiled section.

17. A high speed, low mechanical inertia machine for constructing coiled wire mesh screening comprising
means for drawing wire from a source and feeding it to apparatus for forming it into an elongated coil,
means for forming the wire received from said drawing means into an elongated coil and for rotating the coil about its axis,
means for receiving the rotating coil comprising elongated trough means,
means for severing the coil when a predetermined axial length thereof is located in said receiving means,
means for releasably retaining the severed coil in a predetermined position within said receiving means comprising
releasable gripping means in said trough means for retaining the elongated coil in a predetermined axial and longitudinal position as a result of tension forces exerted by previously formed elongated coils,
first means for adjusting the axial position of the severed coil within said receiving means comprising
finger means located so as to be movable into pulling contact with previously formed elongated coils to pull them laterally away from said receiving means, and
means for actuating said finger means into and out of contact with such previously formed coils,
second means for adjusting the longitudinal position of the severed coil, and
transmission means for actuating said severing means and said first and second adjusting means.

18. The machine of claim 17 wherein
said severing means comprises
a fixed blade having
an aperture therein through which the elongated, rotating coil may be passed,
a movable blade located so as to move past said aperture, and
means for supporting said blade for movement past said aperture.

19. The machine of claim 18 including
means for biasing said movable blade into abutment with said fixed blade to ensure a severing relationship therebetween.

20. The machine of claim 17 wherein
said transmission means includes
a single power input means for actuating a plurality of power output means, the latter including
first cam means for cyclically actuating said severing means,
second cam means for cyclically actuating said first adjusting means to pull the next-to-the-last formed elongated coil away from said receiving means while positioning the last-formed elongated coil relative to said retaining means, and
third cam means for actuating said receiving means in opposite directions a distance equal to approximately one-half the coil pitch dimension during each half cycle of operation of said machine.

21. A mesh weaving machine comprising
means for drawing wire from a continuous source of wire,
means for coiling the wire,
means for receiving and holding the coiled wire,
means for severing the coiled wire between said coiling means and said receiving means when a predetermined length of coiled wire is located in said receiving means,
means for positioning the severed coil of wire in said receiving and holding means such that the coil is maintained in position for accepting the next coil of wire received from said coiling means in woven relationship therewith, and
means for reciprocating said receiving and holding means a distance equal to approximately one-half the pitch of a coil of wire therein, and
a high speed, low inertia power transmission for selectively so actuating said severing means, said positioning means, and said receiving and holding means, including
a housing containing
an oil bath for lubrication of all of the structure therein,
a single power input shaft extending from said housing,
first cam means mounted on said single input shaft,
means extending from said housing actuated by said first cam means in reciprocating and partial universal motion for cyclic actuation of said positioning means,
second cam means mounted on said single input shaft,
means extending from said housing actuated by said second cam means in reciprocating motion for cyclic actuation of said severing means,
third cam means operatively driven by said single input shaft, and
means extending from said housing actuated by said third cam means for movement of said receiving and holding means in a single direction of its reciprocating motion for each actuation of said severing and said positioning means.

22. The machine of claim 21 including
biasing means acting upon said positioning means for maintaining a cooperative mechanical relationship between said first cam means and said cyclic actuation means driven thereby.

23. The machine of claim 21 including
biasing means acting upon said receiving and holding means for maintaining a cooperative mechanical relationship between said third cam means and said movement means driven thereby.

24. The machine of claim 21 wherein
said holding means comprises
a base member,
fixed gripping means mounted upon said base member and extending into cooperative relationship with said receiving means, presser plate means pivotally mounted upon said base member in cooperative relationship with said fixed gripping means, and means mounted on said base member for releasably biasing said presser plate means toward said fixed gripping means.

25. The machine of claim 24 wherein said positioning means comprises a plurality of fingers pivotally movable relative to said receiving and holding means and extending into cooperative relationship therewith for moving the last-formed, severed coil of wire from said receiving means to said holding means and for moving the next-to-the-last-formed severed coil of wire out of said holding means.

* * * * *